US006386538B1

(12) United States Patent
Mejia

(10) Patent No.: US 6,386,538 B1
(45) Date of Patent: May 14, 2002

(54) GAME APPARATUS

(76) Inventor: Gerardo Mejia, 3851 Pennwood Ave., Office G-1, Las Vegas, NV (US) 89102

( * ) Notice: Subject to any disclaimer, the term of this patent is extended or adjusted under 35 U.S.C. 154(b) by 0 days.

(21) Appl. No.: 09/639,256

(22) Filed: Aug. 15, 2000

Related U.S. Application Data

(63) Continuation-in-part of application No. 09/478,285, filed on Jan. 12, 2000, now abandoned.
(60) Provisional application No. 60/115,893, filed on Jan. 14, 1999.

(51) Int. Cl.[7] ..... A63F 9/14
(52) U.S. Cl. ..... 273/118 R; 446/168
(58) Field of Search ..... 463/58, 69; 446/168, 446/170; 273/118 R, 138.1, 138.3, 138.4, 139

(56) References Cited

U.S. PATENT DOCUMENTS 1,374,844 A * 4/1921 Flatow ..... 463/69
1,493,649 A * 5/1924 Schulz ..... 463/69
3,379,440 A * 4/1968 Jaffe ..... 463/69
3,502,332 A * 3/1970 Wolf ..... 463/69
3,665,636 A * 5/1972 Benson et al. ..... 463/69
3,711,094 A * 1/1973 Coffman ..... 463/69
4,153,250 A * 5/1979 Anthony ..... 463/69
4,713,038 A * 12/1987 Wichman et al. ..... 446/168
4,932,917 A * 6/1990 Klitsner ..... 463/69

FOREIGN PATENT DOCUMENTS

DE 2658485 * 6/1978 ..... 446/168

* cited by examiner

*Primary Examiner*—Raleigh W. Chiu

(57) ABSTRACT

A game apparatus for providing a game of chance that can be utilized at various events. The inventive device includes a platform, a plurality of support poles attached to the platform extending upwardly, and a length of track supported upon the support poles in a gradual decline for receiving a plurality of balls. The tracks is comprised of a plurality of corners and obstacles for providing a random selection of balls at the end of the length of track. The balls released from a start gate near the upper portion of the track. The balls randomly pass through the track until they are collected in a single line at the lower portion of the track in a random order. Players can select the first ball, the last ball, specific orders of balls and various other combinations to win a payout similar to horse betting. Each of the balls are distinctly identified from one another.

10 Claims, 10 Drawing Sheets

GAME APPARATUS

CROSS-REFERENCE TO RELATED U.S. PATENT APPLICATION

I hereby claim benefit under Title 35, United States Code, Section 119(e) of U.S. Provisional Patent Application 60/115,893, filed Jan. 14, 1999.

CROSS REFERENCE TO RELATED PATENT APPLICATION

This application is a continuation of U.S. patent application Ser. No. 09/478,285 filed on Jan. 12, 2000 now abandoned and entitled "Game Apparatus". The Ser. No. 09/478,285 is currently pending. The inventor listed within the Ser. No. 09/478,285 patent application, Gerardo E. Mejia, is the same as the current patent application.

BACKGROUND OF THE INVENTION

1. Field of the Invention

The present invention relates generally to games of chance and more specifically it relates to a game apparatus for providing a game of chance that can be utilized at various events.

2. Description of the Prior Art

Games of chance have been in use for years. The games typically involve the selection of various numbered balls wherein the user selects a pattern prior to beginning the game. If the selected numbered balls equals the selected pattern of the player, a payout is paid to the player.

While these devices may be suitable for the particular purpose to which they address, they are not as suitable for providing a game of chance that can be utilized at various events. Some conventional games of chance are not completely random and often result in the odds in favor of the casino or house.

In these respects, the game apparatus according to the present invention substantially departs from the conventional concepts and designs of the prior art, and in so doing provides an apparatus primarily developed for the purpose of providing a game of chance that can be utilized at various events.

SUMMARY OF THE INVENTION

In view of the foregoing disadvantages inherent in the known types of games now present in the prior art, the present invention provides a new game apparatus construction wherein the same can be utilized for providing a game of chance that can be utilized at various events.

The general purpose of the present invention, which will be described subsequently in greater detail, is to provide a new game apparatus that has many of the advantages of the games mentioned heretofore and many novel features that result in a new game apparatus which is not anticipated, rendered obvious, suggested, or even implied by any of the prior art games, either alone or in any combination thereof.

To attain this, the present invention generally comprises a platform, a plurality of support poles attached to the platform extending upwardly, and a length of track supported upon the support poles in a gradual decline for receiving a plurality of balls. The tracks is comprised of a plurality of corners and obstacles for providing a random selection of balls at the end of the length of track. The balls released from a start gate near the upper portion of the track. The balls randomly pass through the track until they are collected in a single line at the lower portion of the track in a random order. Players can select the first ball, the last ball, specific orders of balls and various other combinations to win a payout. Each of the balls are distinctly identified from one another.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a game apparatus that will overcome the shortcomings of the prior art devices.

A second object is to provide a game apparatus for providing a game of chance that can be utilized at various events.

Another object is to provide a game apparatus that is completely random.

An additional object is to provide a game apparatus that is enjoyable for players of all ages.

A further object is to provide a game apparatus that can be utilized at casinos, charities and various other events.

Another object is to provide a game apparatus that provides a random selection of balls.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
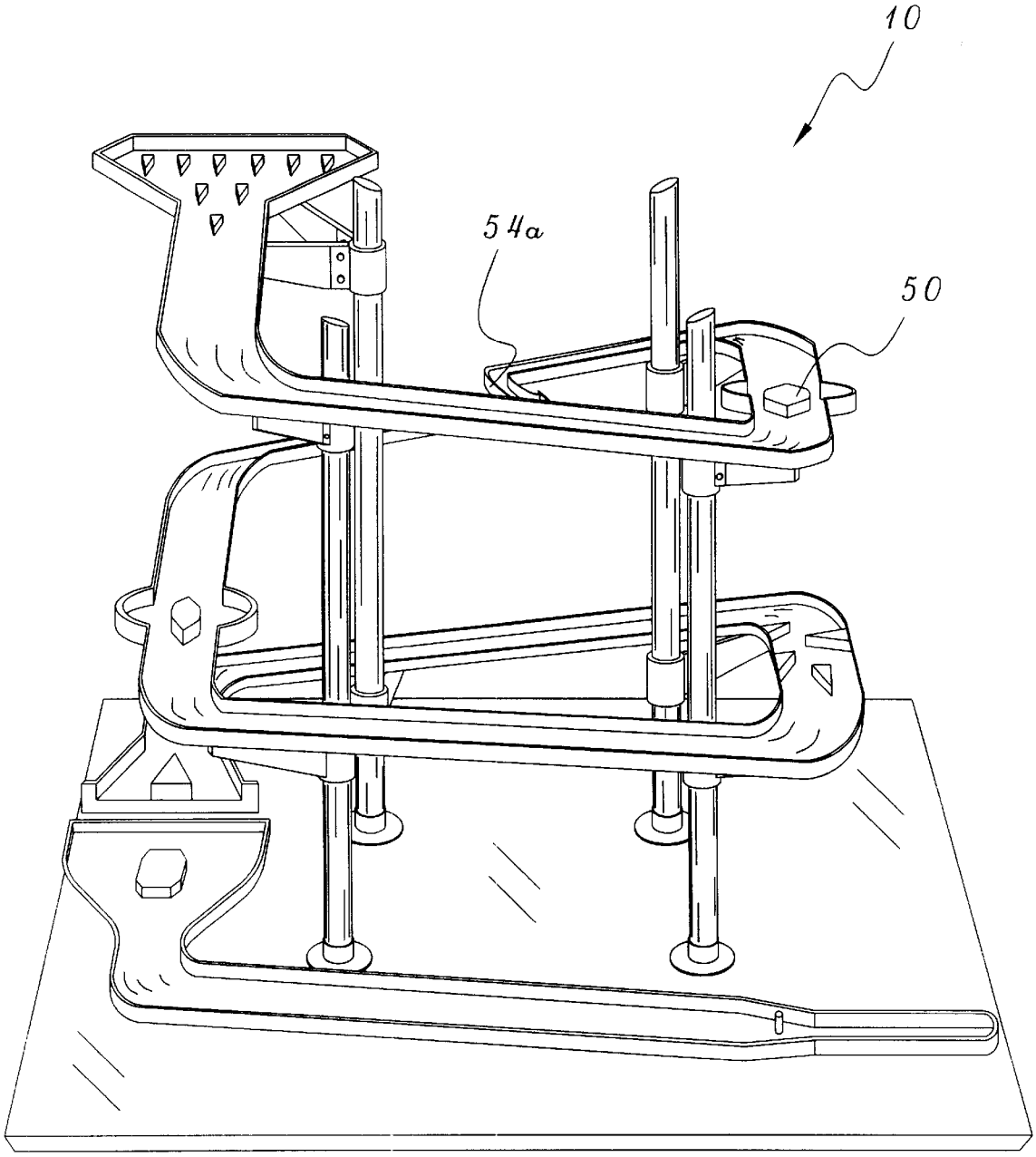
FIG. 1 is an upper perspective view of the present invention.

Turning now descriptively to the drawings, in which similar reference characters denote similar elements throughout the several views, FIGS. 1 through 18 illustrate a game apparatus 10, which comprises a platform 30, a plurality of support poles 20 attached to the platform 30 extending upwardly, and a length of track 40 supported upon the support poles 20 in a gradual decline for receiving a plurality of balls 12. The track 40*s* is comprised of a plurality of corners and obstacles for providing a random selection of balls 12 at the end of the length of track 40. The balls 12 released from a start gate 43 near the upper portion of the track 40. The balls 12 randomly pass through the track 40 until they are collected in a single line at the lower portion of the track 40 in a random order. Players can select the first ball, the last ball, specific orders of balls 12 and various other combinations to win a payout. Each of the balls 12 are distinctly identified from one another.

Figure 2:
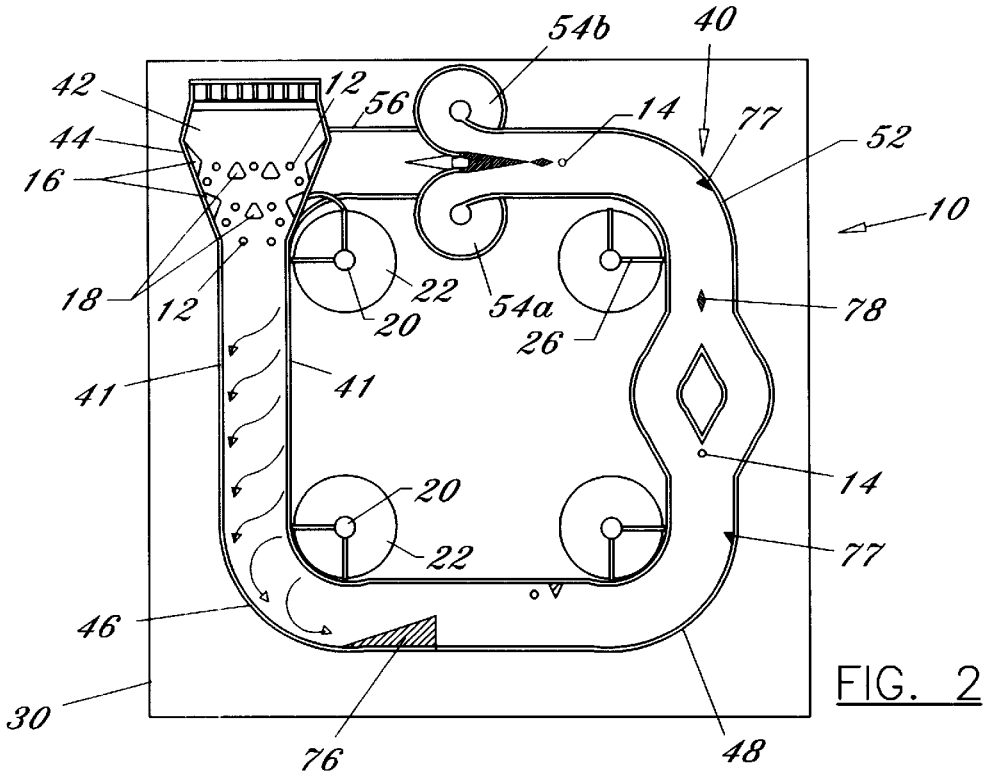
FIG. 2 is a top view of the present invention.
Figure 4:
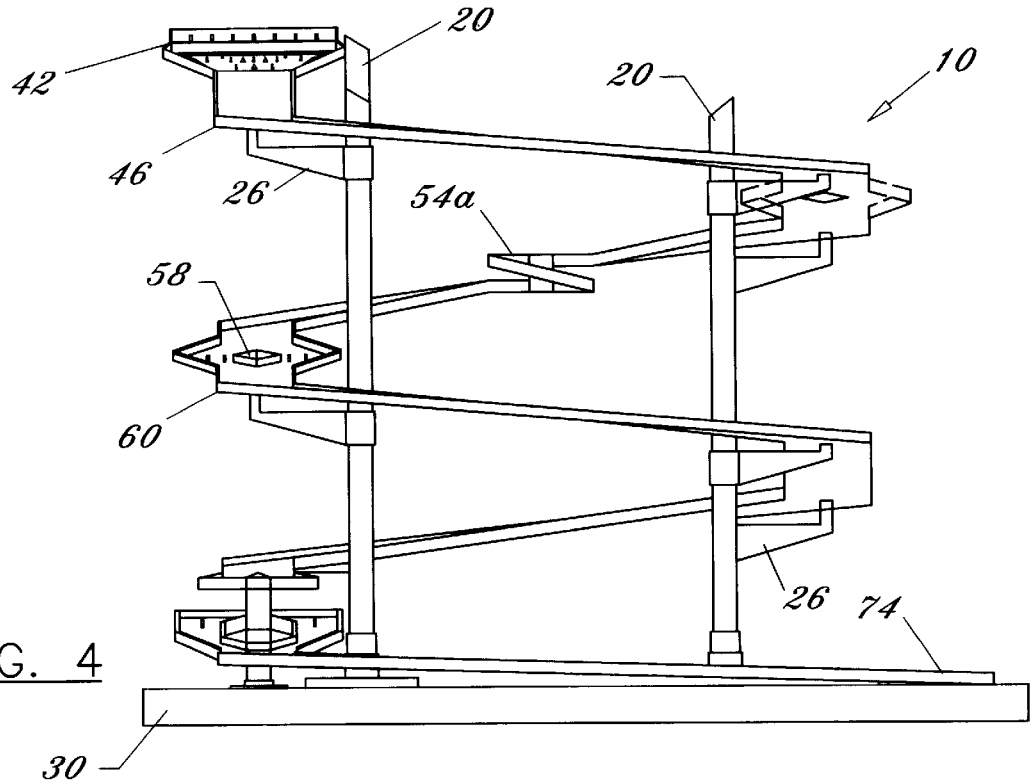
FIG. 4 is a front view of the present invention.
Figure 5:
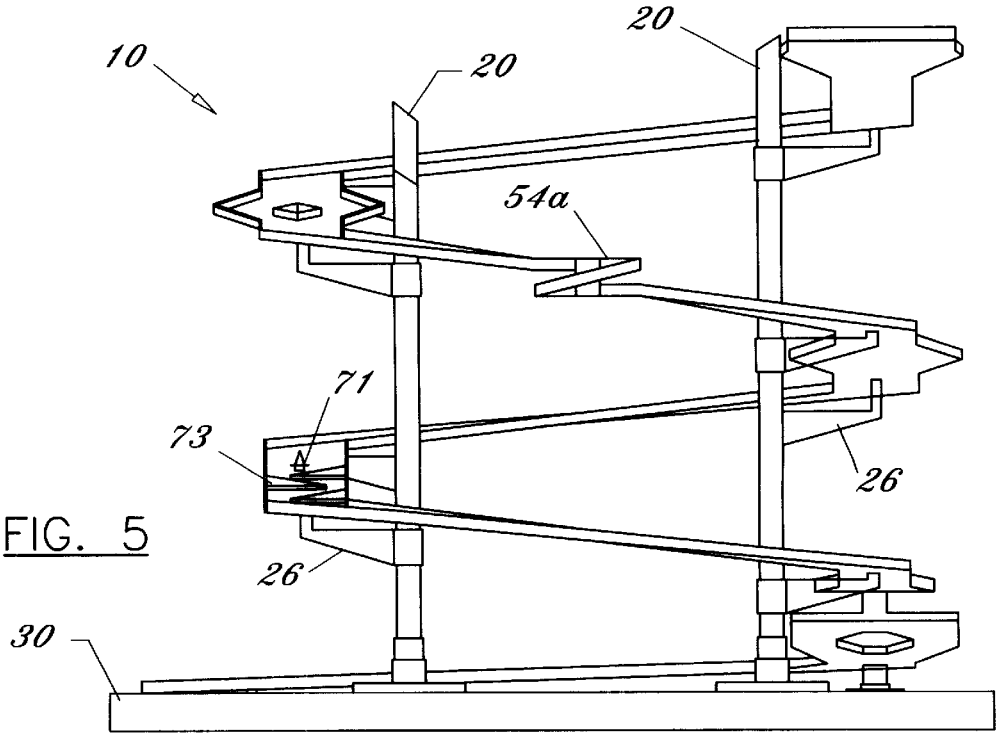
FIG. 5 is a rear view of the present invention.
Figure 6:
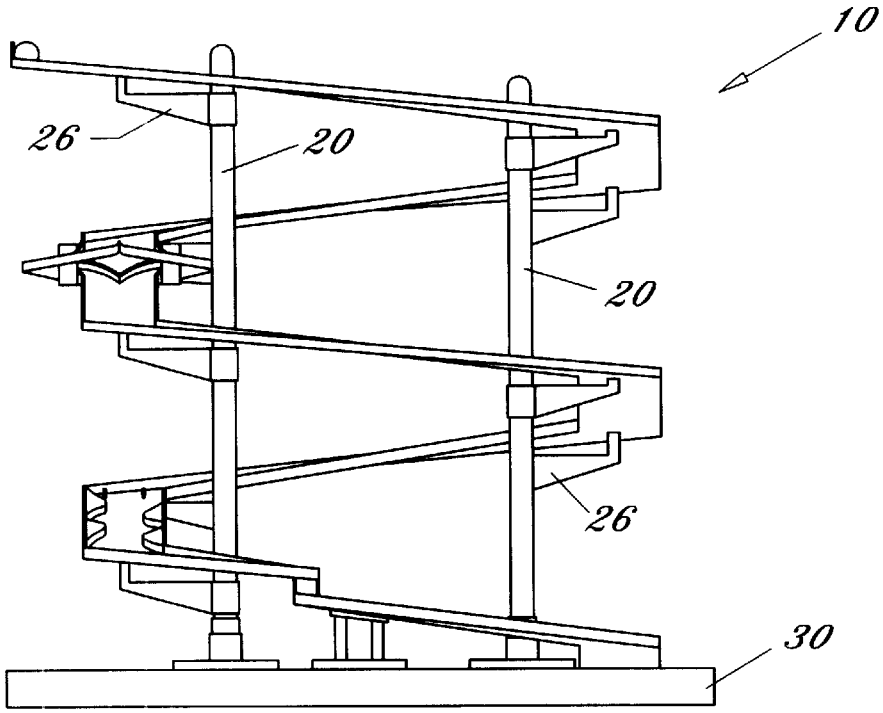
FIG. 6 is a left side view of the present invention.
Figure 7:
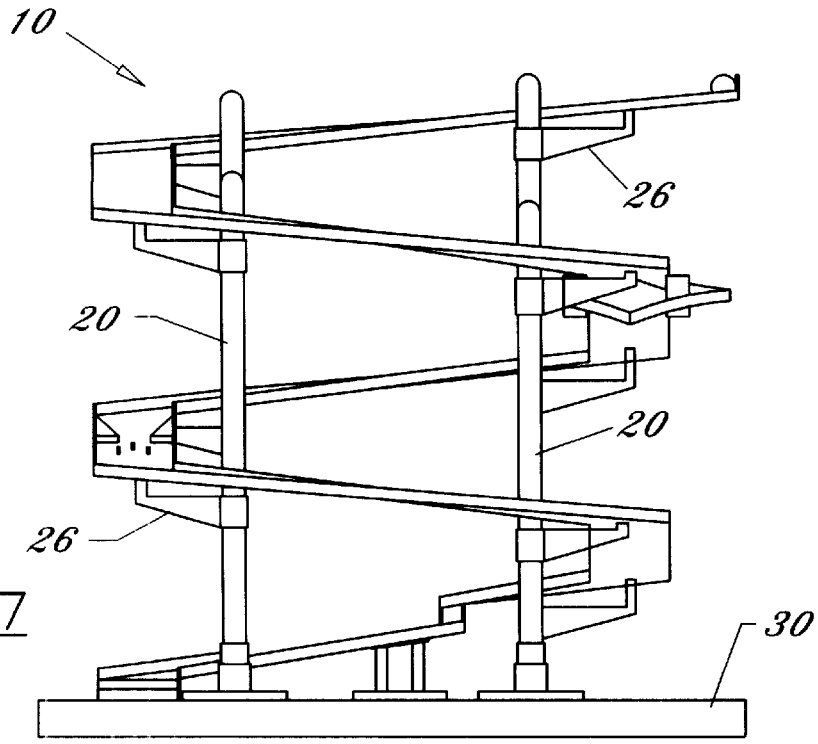
FIG. 7 is a right side view of the present invention.
Figure 8:
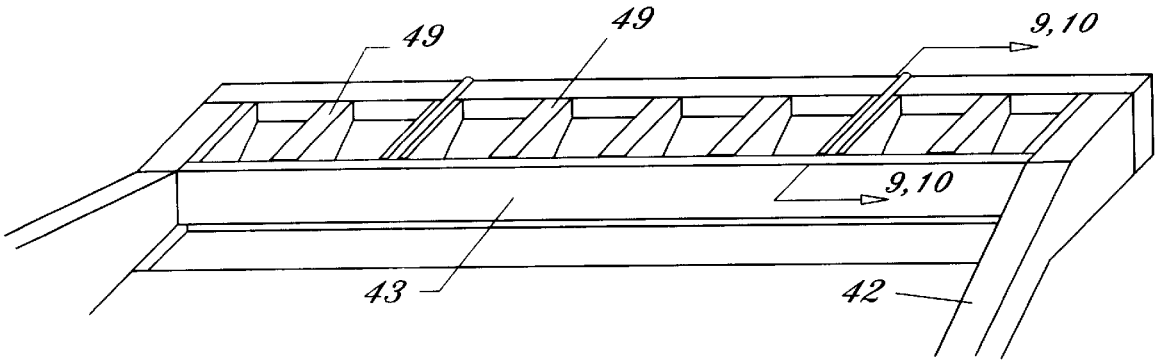
FIG. 8 is a magnified upper perspective view of the starting portion.

As best shown in FIGS. 2, 4 and 5 of the drawings, a platform 30 is provided. As shown in FIGS. 4 and 5 of the drawings, the platform 30 preferably has a generally flat structure thereto. The platform 30 may be constructed of various well-known materials and may be comprised of any well-known shape as can be appreciated by one skilled in the art.

As shown in FIGS. 1 through 7 of the drawings, a plurality of support poles 20 are attached to the platform 30 and extend upwardly thereby supporting the track 40. The support poles 20 preferably each have a base 22 that is attached to the platform 30 by conventional fasteners. The support poles 20 may be constructed of any well-known materials and shapes.

It can be appreciated that the support poles 20 may be utilized by themselves without being attached to a platform 30 thereby supporting the track 40 above a ground surface. As shown in FIGS. 2, 3, 6, 7, 13 and 14 of the drawings, a plurality of support brackets 26 are attached between the support poles 20 and the length of track 40 thereby supporting the length of track 40.

As shown in FIGS. 1 through 7 of the drawings, the track 40 is an elongated structure with a plurality of obstacles and corners 46, 48, 52, 56, 60, 62, 64, 66, 72. The track 40 has an upper portion that descends in a spiral-like pattern as best shown in FIGS. 1 through 7 of the drawings. The length of track 40 includes a floor with opposing side walls 41 for supporting and retaining a plurality of balls 12 within the length of track 40.

Figure 16:
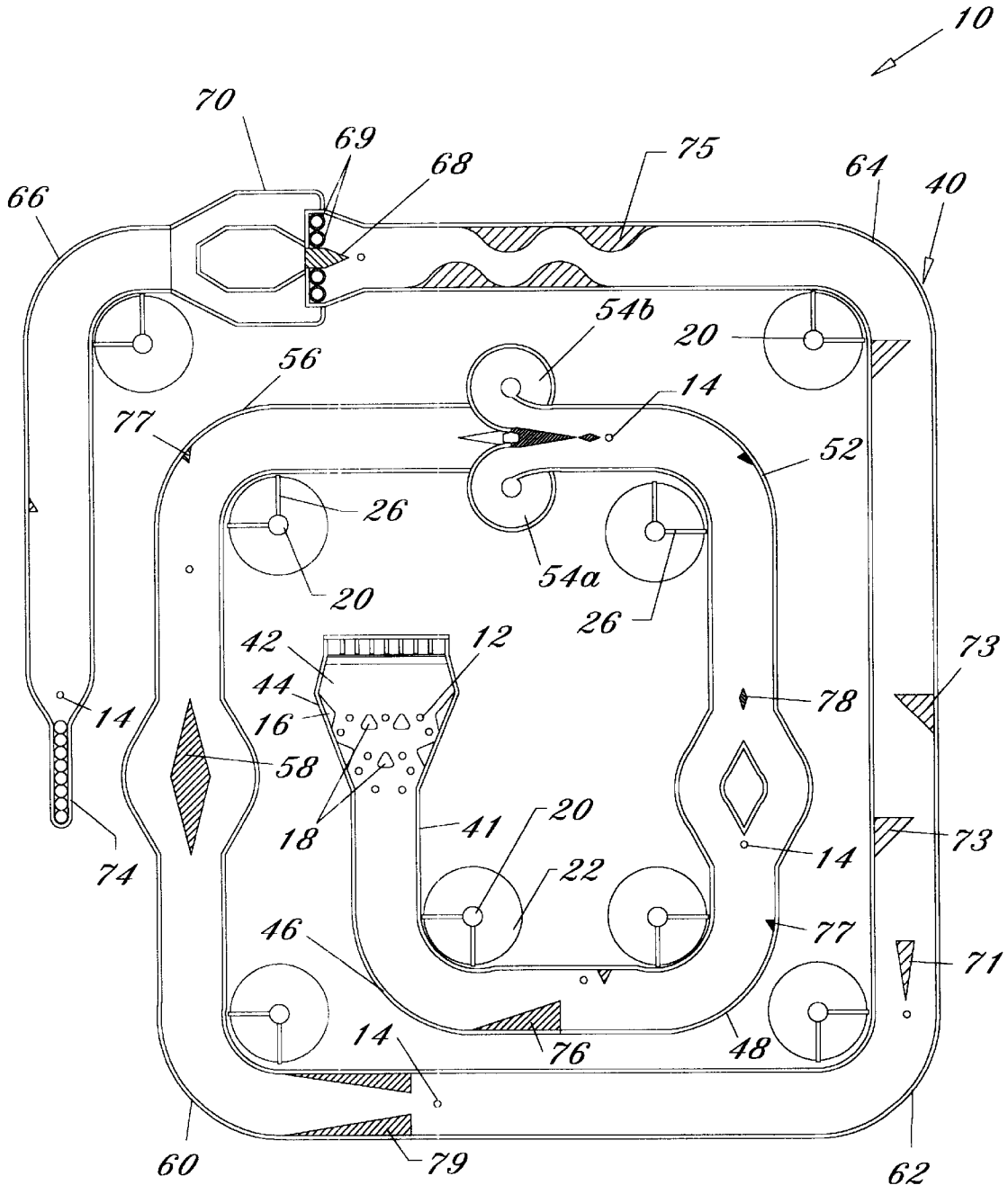
FIG. 16 is a top view of a first alternative embodiment.
Figure 17:
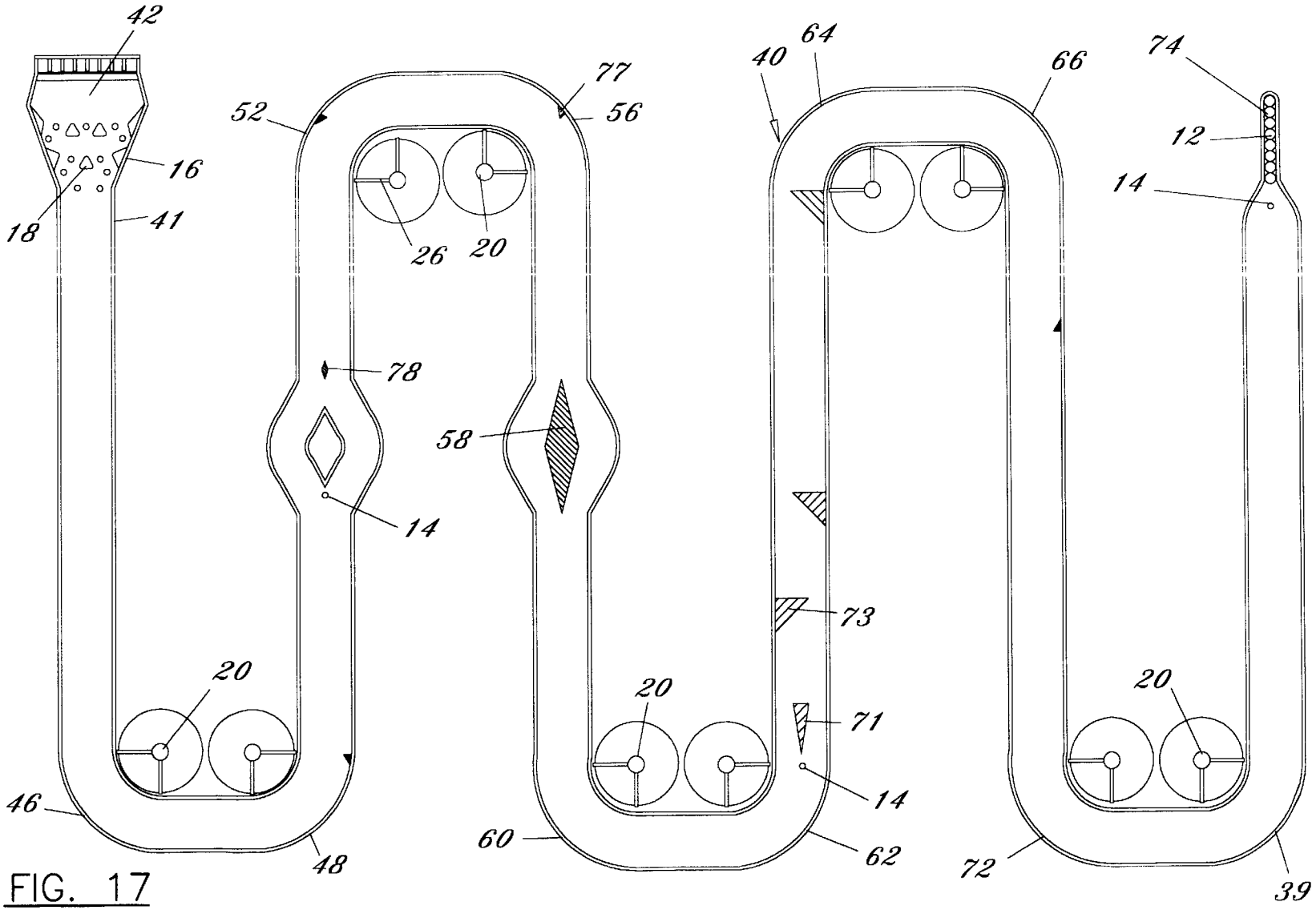
FIG. 17 is a top view of a second alternative embodiment.
Figure 18:
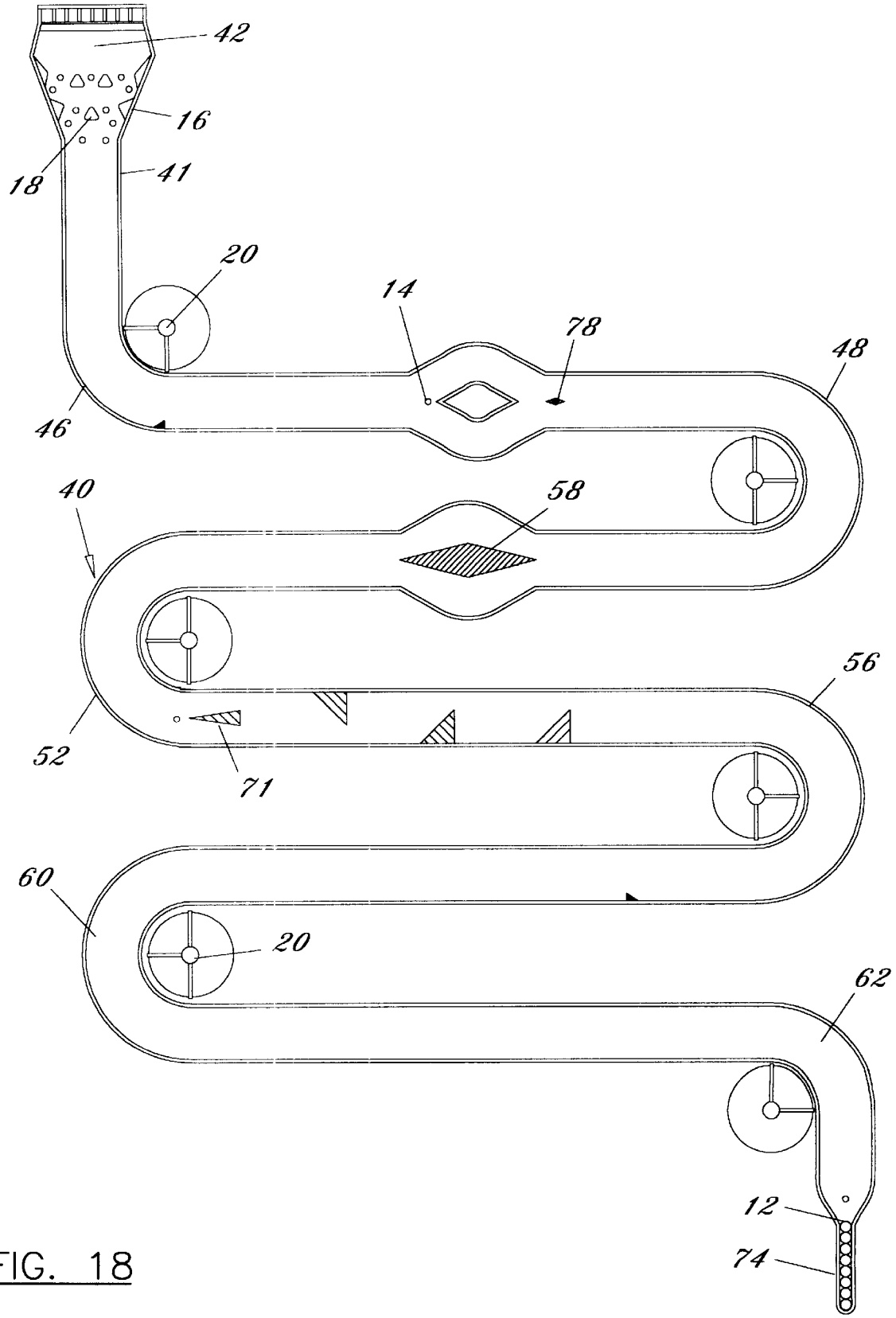
FIG. 18 is a top view of a third alternative embodiment.

The floor of the track 40 may be covered with a cloth-like material, stained or painted. The track 40 may be comprised of any well-known material such as wood, metal, or plastic. The track 40 may be comprised of various shapes and designs as shown in FIG. 16 showing a first alternative embodiment, FIG. 17 showing a second alternative embodiment, and FIG. 18 showing a third alternative embodiment. FIG. 17 shows a tenth corner 39 added towards the latter portion of the present invention. It can also be appreciated that the track 40 may have various other shapes and designs other than those shown within the attached drawings.

As shown in FIGS. 1, 2, 8, 9 and 10, the track 40 includes a start section 42 at the upper portion. The start section 42 is preferably broader than most of the track 40, however the start section 42 may be narrower or the same width as the length of track 40. The start section 42 preferably includes a tapering portion 44 that tapers toward the width of the remaining length of track 40.

Figure 9:
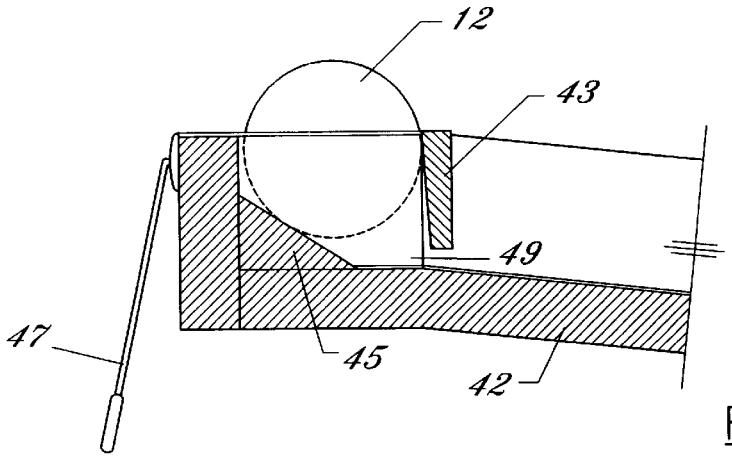
FIG. 9 is a cutaway view taken along line 9—9 of FIG. 8.
Figure 10:
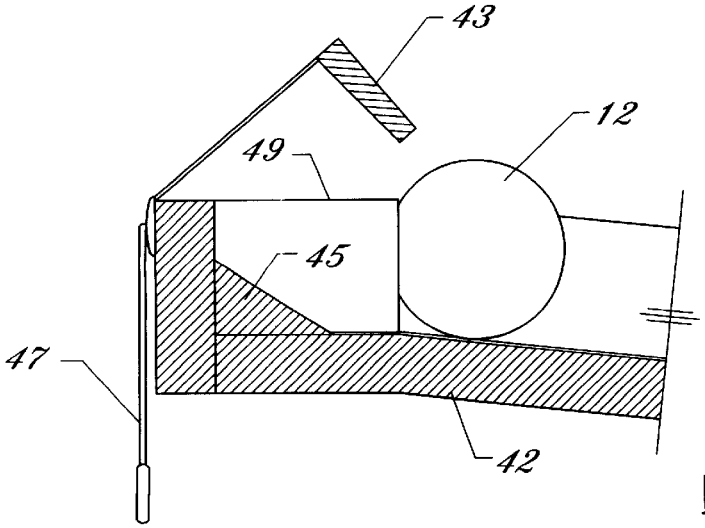
FIG. 10 is a cutaway view taken along line 10—10 of FIG. 8 showing the starting gate in the elevated position.
Figure 11:
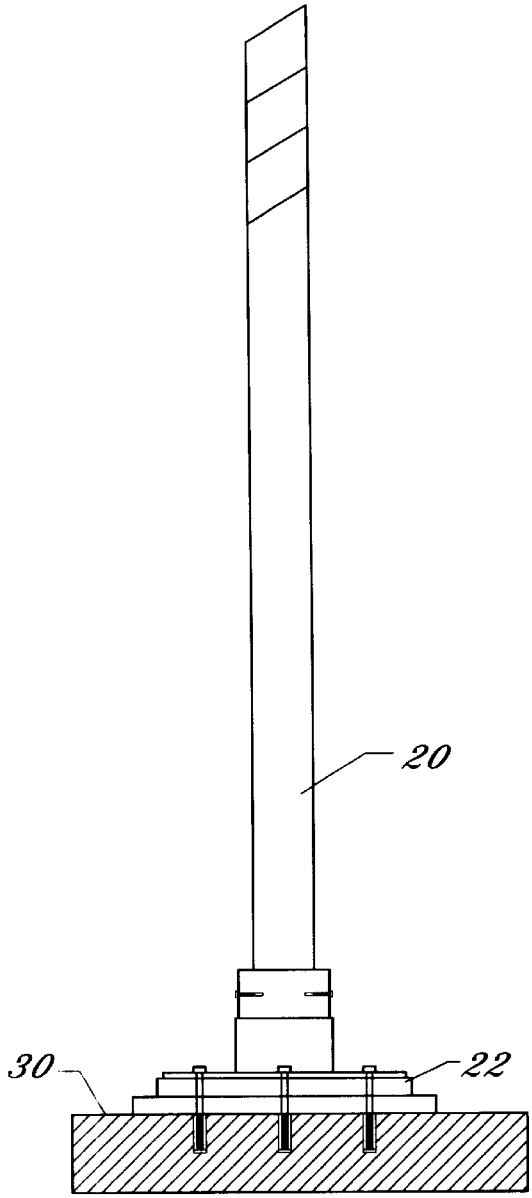
FIG. 11 is a side view of the support pole attached to the platform.

As shown in FIGS. 1, 2, 8, 9 and 10 of the drawings, the start section 42 includes a start gate 43 pivotally attached to a rear shoulder of the start section 42. As best shown in FIGS. 9 and 10 of the drawings, a lever 47 is attached to start gate 43 that allows the user to apply a pivoting force upon the start gate 43 for elevating the start gate 43. It can be appreciated that a conventional motor or actuator may operate the start gate 43 which will not be discussed for obvious reasons.

The start gate 43 preferably includes a plurality of partition members 49 for separating the balls 12 from one another. It can be appreciated that the partition members 49 may be attached to the start section 42 instead of the start gate 43 to reduce the weight of the start gate 43. It can also be appreciated that partition members 49 are not needed to retain the balls 12 within the start gate 43.

As best shown in FIGS. 9 and 10 of the drawings, a ramp 45 is preferably secured to the floor of the start section 42 within the start gate 43 for elevating the balls 12 on an incline for allowing the velocity of the balls 12 to be increased significantly immediately after the start gate 43 is opened.

As shown in FIG. 2 of the drawings, a plurality of side members 16 at attached to the side walls 41 of the track 40 within the start section 42. The side member preferably angle outwardly thereby directing the balls 12 toward the center portion of the track 40.

As further shown in FIG. 2 of the drawings, a plurality of tapered members are attached within the central portion of the start section 42 in front of the start gate 43. The narrow ends of the tapered members are in opposition to the start gate 43 for separating the balls 12 after their initial release from the start gate 43.

After the balls 12 pass through the tapering portion 44 of the start section 42, the balls 12 pass through a straight portion of the track 40 as further shown in FIG. 2 of the drawings. A first corner 46 of the track 40 redirects the balls 12 at approximately a ninety-degree angle as shown in FIG. 2 of the drawings. An angled member 76 is preferably attached to one of the side walls 41 that directs the balls 12 out into the center portion of the track 40.

After the balls 12 pass the angled member 76, they enter a second corner 48 that directs the balls 12 at approximately a ninety-degree angle. A first divider 50 is positioned within the center portion of the track 40 after the second corner 48 as best shown in FIG. 2 of the drawings. The overall width of the track 40 is preferably broadened surrounding the first divider 50 to prevent congestion of the balls 12 during play. A center member 78 is positioned after the first divider 50 as shown in FIG. 2 which has a smaller width than the first divider 50.

As further shown in FIG. 2 of the drawings, a third corner 52 is positioned after the center member 78 for directing the balls 12 approximately ninety-degrees similar to the first corner 46 and the second corner 48. The balls 12 are directed toward a pair of looped portions 54*a–b* as shown in FIG. 2 which separates the balls 12 into two groups. The balls 12 are accumulated below the looped portions 54*a–b* upon the track 40 as shown in FIGS. 2 and 5 of the drawings.

Figure 3:
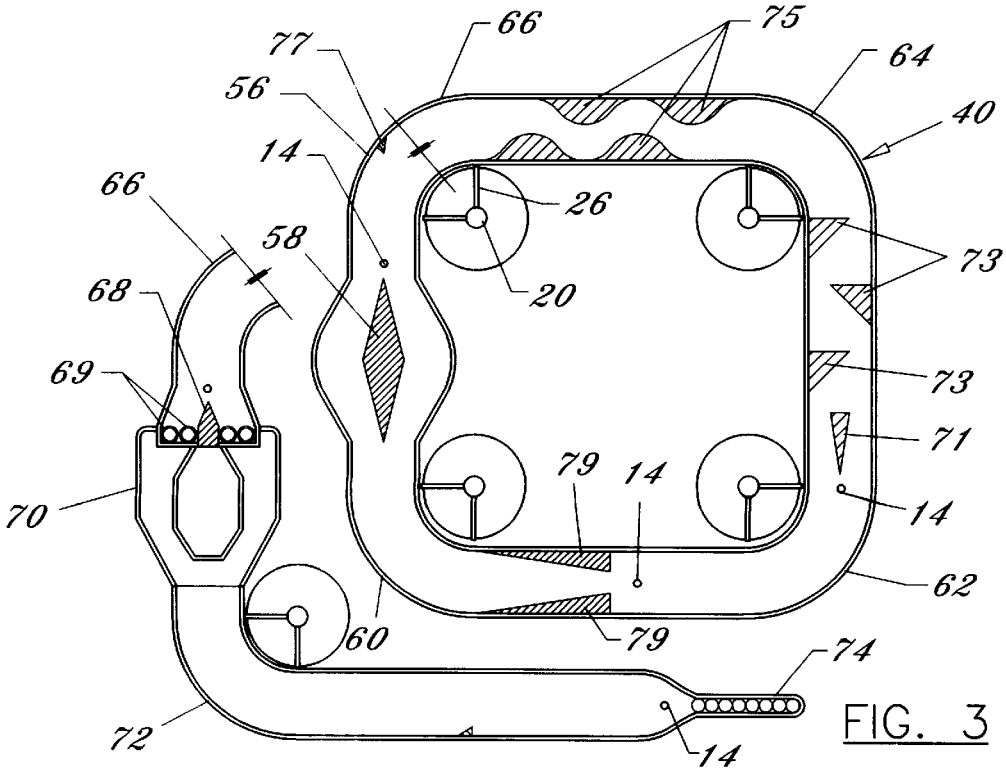
FIG. 3 is a cutaway top view of the present invention.

As shown in FIGS. 2 and 3 of the drawings, a fourth corner 56 is positioned within the track 40 after the pair of looped portions 54*a–b*. The fourth corner 56 directs the balls 12 approximately ninety-degrees to a path similar to the initial starting velocity of the balls 12. After the fourth corner 56, a second divider 58 is positioned within the track 40 similar to the first divider 50 as shown in FIG. 3 of the drawings. The track 40 is widened about the second divider 58 to prevent congestion of the balls 12 during play.

As further shown in FIG. 3 of the drawings, after the second divider 58 a fifth corner 60 is positioned within the length of track 40 that directs the balls 12 at approximately ninety-degrees. After the fifth corner 60, a pair of opposing narrowing members 79 are positioned about the opposing side walls 41 of the track 40 for narrowing the side walls 41 in a tapered effect. A bumper post 14 is preferably positioned opposite of the opening between the narrowing members 79 as shown in FIG. 3 of the drawings.

As shown in FIG. 3 of the drawings, a sixth corner 62 is positioned within the track 40 after the narrowing members 79. The sixth corner 62 preferably directs the balls 12 approximately ninety-degrees. As further shown in FIG. 3 of the drawings, a front divider 71 is positioned within the track 40 followed by a plurality of extended members 73 attached adjacent the side walls 41 of the track 40. The extended members 73 preferably are angled outwardly toward the center portion of the track 40 as shown in FIG. 3 of the drawings.

As shown in FIG. 3 of the drawings, an seventh corner 64 is positioned within the track 40 after the extended members 73. The seventh corner 64 directs the balls 12 at approximately a ninety-degree angle with respect to the track 40 as shown in FIG. 3 of the drawings. As shown in FIG. 3, a plurality of curved members 75 are positioned adjacent the side walls 41 of the track 40 forming a narrow curved passageway for the balls 12 to travel through.

As shown in FIG. 3 of the drawings, an eighth corner 66 is positioned within the track 40 after the curved members 75. The eighth corner 66 directs the balls 12 at approximately a ninety-degree angle with respect to the track 40 as shown in FIG. 3 of the drawings.

After the eighth corner 66, a third divider 68 is positioned within the track 40 with a plurality of apertures 69 on opposing sides of the third divider 68 for receiving the balls 12. The balls 12 pass through the apertures 69 and are dropped upon the receiver portion 70 of the track 40 positioned below the apertures 69 as shown in FIG. 4 of the drawings.

As shown in FIG. 3 of the drawings, a ninth corner 72 is positioned within the track 40 after the apertures 69 and the third divider 68. The seventh corner 64 directs the balls 12 at approximately a ninety-degree angle with respect to the track 40 as shown in FIG. 3 of the drawings. The track 40 extends substantially straight after the seventh corner 64 as shown in FIG. 3.

As further shown in FIG. 3 of the drawings, a narrow portion 74 is positioned at the end of the track 40 for receiving and capturing the balls 12 in a single file order as they are received. The narrow portion 74 preferably has an open portion for allowing an operator of the game to view the winning ball 12 or winning order of balls 12.

The balls 12 utilized within the present invention may be constructed of various materials commonly found. Each of the balls 12 is identified by a color or a letter or a number or any combination thereof.

Figure 12:
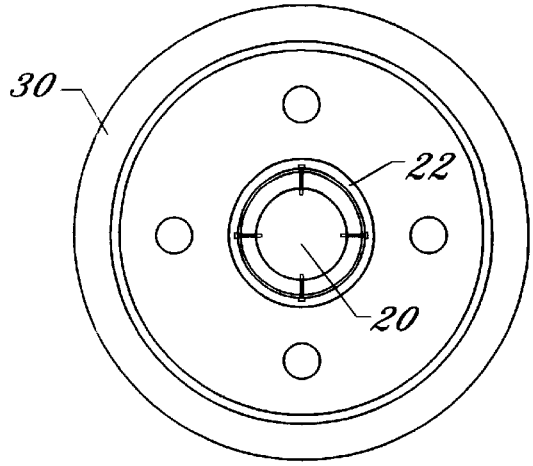
FIG. 12 is a top view of the bumper post.
Figure 13:
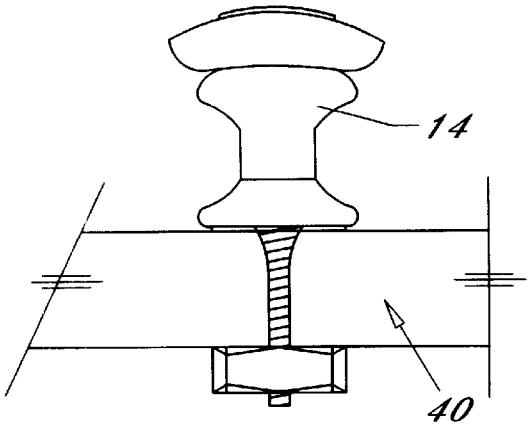
FIG. 13 is side view of the bumper post.
Figure 14:
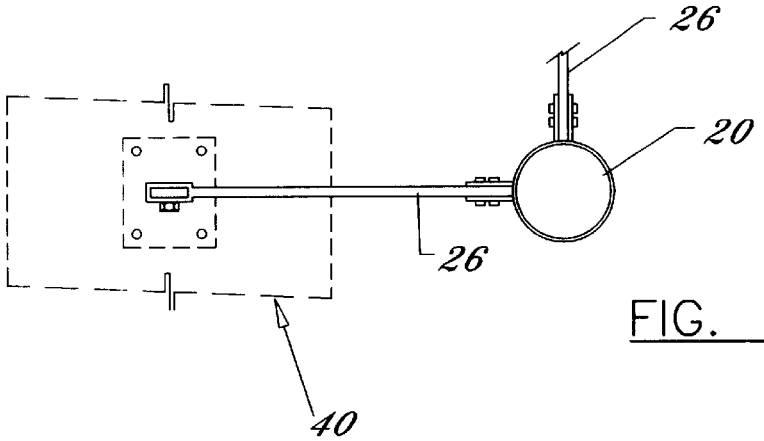
FIG. 14 is a top view of the support pole and support bracket.
Figure 15:
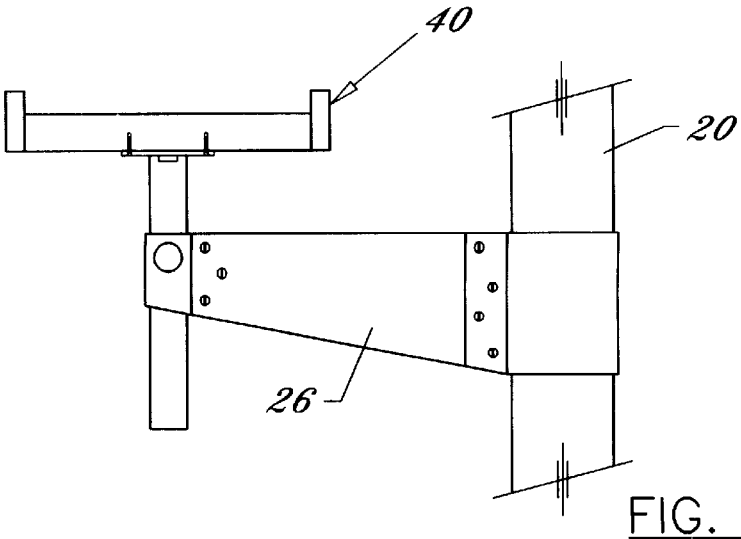
FIG. 15 is a side view of the support pole and support bracket.

As shown in FIGS. 1, 2 and 3 of the drawings, there are preferably a plurality of bumper posts 14 throughout the track 40 particularly in front of obstacles to protect the obstacles from damage. As shown in FIG. 12 of the drawings, the bumper posts 14 are comprised of a hardened material attached to the track 40 with an upper rubber ring for preventing damage to the balls 12 or the track 40. As further shown in FIGS. 1, 2 and 3 of the drawings, a plurality of corner members 77 are preferably included about some or all of the corners 46, 48, 52, 56, 60, 62, 64, 66, 72.

During play, one or more players select a ball 12 or a combination of balls 12 that they believe will be collected within the narrow portion 74 of the track 40. The players place bets accordingly and the balls 12 are positioned within the start gate 43 which is lowered within the start section 42. Play is begun after bets are placed by the game operator manipulating the lever 47 which elevates the start gate 43 as shown in FIG. 10 of the drawings. The balls 12 rapidly move forwardly from the ramp 45 along the track 40. Since the track 40 is declined the balls 12 continue along the track 40 engaging the obstacles and changing order constantly. After the balls 12 reach the ninth corner 72 as shown in FIG. 3 of the drawings, they proceed to the narrow portion 74 of the track 40. The first ball 12 to reach the narrow portion 74 is the first ball 12 to be positioned within the narrow portion 74 followed by the remaining balls 12. Payouts to players are made based upon various combinations of balls 12 which are predetermined. The bets and payouts may be similar to those made at a horse race. Play is repeated by removing the balls 12 from the narrow portion 74 and repositioning the balls 12 within the start gate 43.

As to a further discussion of the manner of usage and operation of the present invention the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A game apparatus, comprising:

a plurality of support members;

a length of track having a first end and a second end supported about said plurality of support members, wherein said length of track descends from said first end to said second end;

said track includes a floor with opposing side walls for supporting and retaining a plurality of balls within said length of track;

said length of track comprising a first corner, a second corner connected to said first corner, a third corner connected to said second corner, a fourth corner connected to said third corner, a fifth corner connected to said fourth corner, a sixth corner connected to said fifth corner, a seventh corner connected to said sixth corner, an eighth corner connected to said seventh corner, and a ninth corner connected to said eighth corner;

a plurality of obstacles positioned upon said length of track, said plurality of obstacles comprised of a plurality of curved members for curving the side walls of said length of track, a plurality of angled members, a plurality of corner members, a plurality of center members, a plurality of dividers positioned centrally within said length of track, and a plurality of narrowing members for narrowing the width of said length of track; and a starting apparatus within said first end for allowing the release of a plurality of balls onto said track, wherein said starting apparatus comprises:

a ramp attached to said first end of said length of track;

a start gate pivotally attached to said first end of said track and surrounding said ramp;

a lever arm attached to said start gate for allowing manipulation of said start gate; and a plurality of partition members within said start gate for separating a plurality of balls.

2. The game apparatus of claim 1, wherein said second end is comprised of a narrow portion for receiving a plurality of balls in a received order.

3. The game apparatus of claim 1, wherein said length of track includes a plurality of obstructions.

4. The game apparatus of claim 3, wherein said plurality of obstructions includes at least one divider member.

5. The game apparatus of claim 3, wherein said plurality of obstructions includes at least one pair of looped portions.

6. A game apparatus, comprising:

a platform;

a plurality of support members attached to and extending from said platform;

a plurality of balls having separate visual identifiers;

a length of track having a first end and a second end supported about said plurality of support members, wherein said length of track descends from said first end to said second end; said track includes a floor with opposing side walls for supporting and retaining a plurality of balls within said length of track;

said length of track comprising a first corner, a second corner connected to said first corner, a third corner connected to said second corner, a fourth corner connected to said third corner, a fifth corner connected to said fourth corner, a sixth corner connected to said fifth corner, a seventh corner connected to said sixth corner, an eighth corner connected to said seventh corner, and a ninth corner connected to said eighth corner; a plurality of obstacles positioned upon said length of track, said plurality of obstacles comprised of a plurality of curved members for curving the side walls of said length of track, a plurality of angled members, a plurality of corner members, a plurality of center members, a plurality of dividers positioned centrally within said length of track, and a plurality of narrowing members for narrowing the width of said length of track; and a starting apparatus within said first end for allowing the release of a plurality of balls onto said track, wherein said starting apparatus comprises:

a ramp attached to said first end of said length of track;

a start gate pivotally attached to said first end of said track and surrounding said ramp;

a lever arm attached to said start gate for allowing manipulation of said start gate; and a plurality of partition members within said start gate for separating a plurality of balls.

7. The game apparatus of claim 6, wherein said second end is comprised of a narrow portion for receiving a plurality of balls in a received order.

8. The game apparatus of claim 6, wherein said length of track includes a plurality of obstructions.

9. The game apparatus of claim 8, wherein said plurality of obstructions includes at least one divider member.

10. The game apparatus of claim 8, wherein said plurality of obstructions includes at least one pair of looped portions.

* * * * *